US009090858B2

(12) United States Patent
Lant et al.

(10) Patent No.: US 9,090,858 B2
(45) Date of Patent: Jul. 28, 2015

(54) MILDLY ALKALINE, LOW-BUILT, SOLID FABRIC TREATMENT DETERGENT COMPOSITION COMPRISING PHTHALIMIDO PEROXY CAPROIC ACID

(75) Inventors: Neil Joseph Lant, Newcastle upon Tyne (GB); Gregory Scot Miracle, Hamilton, OH (US); Alan Thomas Brooker, Newcastle (GB); Nigel Patrick Somerville Roberts, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 296 days.

(21) Appl. No.: 12/896,189

(22) Filed: Oct. 1, 2010

(65) Prior Publication Data

US 2011/0021406 A1 Jan. 27, 2011

Related U.S. Application Data

(63) Continuation of application No. PCT/US2010/041270, filed on Jul. 8, 2010.

(60) Provisional application No. 61/325,455, filed on Apr. 19, 2010, provisional application No. 61/325,398, filed on Apr. 19, 2010, provisional application No. 61/224,150, filed on Jul. 9, 2009.

(51) Int. Cl.

| | |
|---|---|
| ***C11D 3/395*** | (2006.01) |
| ***C11D 3/37*** | (2006.01) |
| ***C11D 3/39*** | (2006.01) |
| ***C11D 3/10*** | (2006.01) |

(52) U.S. Cl.

CPC ..... *C11D 3/3945* (2013.01); *C11D 3/10* (2013.01); *C11D 3/3932* (2013.01)

(58) Field of Classification Search

USPC ..... 510/302, 276, 307, 309, 310, 311

See application file for complete search history.

(56) References Cited

U.S. PATENT DOCUMENTS

| | | | | | |
|---|---|---|---|---|---|
| 4,707,292 | A | * | 11/1987 | Sano et al. | 510/404 |
| 5,374,369 | A | * | 12/1994 | Angevaare et al. | 510/220 |
| 5,437,686 | A | * | 8/1995 | Heffner et al. | 8/111 |
| 5,576,282 | A | * | 11/1996 | Miracle et al. | 510/276 |
| 5,958,871 | A | * | 9/1999 | Clare | 510/507 |
| 6,380,144 | B1 | | 4/2002 | Bailley | |
| 6,689,739 | B1 | | 2/2004 | Hall | |
| 2005/0020469 | A1 | * | 1/2005 | Rahse et al. | 510/444 |
| 2007/0191250 | A1 | * | 8/2007 | Lant | 510/392 |
| 2008/0045433 | A1 | * | 2/2008 | Blagg et al. | 510/438 |
| 2010/0022431 | A1 | | 1/2010 | Lant et al. | |

FOREIGN PATENT DOCUMENTS

| | | | |
|---|---|---|---|
| DE | 100 20 767 | A1 | 1/2002 |
| EP | 0895777 | A2 | 2/1999 |

OTHER PUBLICATIONS

International Search Report and Written Opinion from the International Searching Authority, International Application No. PCT US2010/041270, mailed on Oct. 14, 2010, 7 pages.

Database WPI Week 199220, Thomson Scientific, London, GB, 1992-1638288, pp. 1-4, 15, 16, Apr. 6, 1992. XP0020603505.

* cited by examiner

*Primary Examiner* — Ling Choi

*Assistant Examiner* — Thuy-Ai Nguyen

(74) *Attorney, Agent, or Firm* — John T. Dipre; Steven W. Miller

(57) ABSTRACT

A solid fabric treatment detergent composition having: (i) detersive surfactant; (ii) phthalimido peroxy caproic acid; (iii) from 0 wt % to 10 wt % zeolite builder; (iv) from 0 wt % to 10 wt % phosphate builder; and (v) optionally from 0 wt % to 10 wt % silicate salt, wherein the upon dilution in deionized water to a concentration of 1 wt % at 20° C., the composition has a pH of from 7.6 to 8.8.

14 Claims, No Drawings

MILDLY ALKALINE, LOW-BUILT, SOLID FABRIC TREATMENT DETERGENT COMPOSITION COMPRISING PHTHALIMIDO PEROXY CAPROIC ACID

CROSS REFERENCE TO RELATED APPLICATION(S)

This application is a Continuation of International Application No. PCT/US2010/041270, filed Jul. 8, 2010, which claims the benefit of U.S. Provisional Application No. 61/325,455, filed Apr. 19, 2010; and U.S. Provisional Application No. 61/325,398, filed Apr. 19, 2010; and U.S. Provisional Application No. 61/224,150, filed Jul. 9, 2009.

FIELD OF THE INVENTION

The present invention relates to solid fabric treatment compositions comprising phthalimido peroxy caproic acid. The compositions of the present invention are low-built, comprising no, or low levels of, zeolite builder and phosphate builder. The compositions of the present invention have a low pH profile, being only mildly alkaline. The compositions of the present invention are preferably laundry detergent compositions, although they can be bleach additive compositions. The compositions of the present invention preferably comprise a bleach catalyst, preferably oxaziridinium-based bleach catalyst. The compositions of the present invention have a very good cold water cleaning performance, even at extremely cold washing temperatures such as 20° C., or even 15° C.

BACKGROUND OF THE INVENTION

Increasing environmental awareness has moved the laundry business towards colder wash temperatures and shorter automatic washing machine cycles. When conventional laundry detergents are used at cold wash temperatures and in shorter wash times, their cleaning performance is reduced; and their bleaching performance is especially reduced.

The present invention overcomes this problem by formulating a phthalimido peroxy caproic acid (PAP) bleaching system at low pH and low builder levels, which provides a fabric treatment composition having an excellent bleaching efficacy.

In addition, calcium carbonate formation is significantly reduced at the low wash liquor pH, which improves the anti-encrustation profile of the composition. This in turn improves the bleaching performance profile of the composition. Without wishing to be bound by theory, the improved anti-encrustation profile ensures the fabric surface is available to the bleaching system because very little or no encrustatation build up occurs on the fabric surface, so optimal bleaching performance is maintained.

The bleaching performance of this composition is further improved when bleach catalysts are additionally incorporated therein, preferred bleaching catalysts are oxaziridinium-based bleach catalysts, transition metal bleach catalysts and bleaching enzymes. Without wishing to be bound by theory, the stability and efficiency of these bleach catalysts are improved by the low pH of the wash liquor, and increased hardness levels in the wash liquor due to the low builder formulation.

Sodium bicarbonate is an excellent buffer salt to obtain the required low pH profile. However, sodium sesquicarbonate can also be used; and sodium sesquicarbonate provides additional benefits including improved dispensing profile and improved storage stability profile. Without wishing to be bound by theory, the additional benefits observed with sodium sesquicarbonate are due to the very low hydration profile of sodium sesquicarbonate; i.e. sodium sesquicarbonate does not further hydrate beyond its dihydrate.

Formulating with a relatively high reserve alkalinity to pH 6.0 ensures the stability of the low pH profile, providing improved robustness of the bleaching system. In addition, carefully choosing a chelant system that has good binding constants to transition metals at the low pH, protect the bleach system and further improve the robustness of the bleach system.

When other components such as hueing agents and brighteners are also incorporated into the composition, careful choice of these ingredients is needed to ensure they are compatible with the more efficient bleach system. Preferably, oxidation resistant hueing agents and oxidation resistant brighteners are incorporated into the composition.

When first wash lipases are also incorporated into the composition, an excellent dingy cleaning performance is observed.

The low pH profile, and increase in wash liquor free hardness levels due to low builder formulation also improves the colour fidelity profile of the composition. Additional colour fidelity benefits are observed when dye lock components are also incorporated into the composition.

Preferably the composition is a solid laundry detergent composition. However, the composition can also be a bleach additive product.

SUMMARY OF THE INVENTION

The present invention relates to a composition as defined by claim 1.

DETAILED DESCRIPTION OF THE INVENTION

Solid fabric treatment detergent composition. The solid fabric treatment detergent composition comprises: (i) detersive surfactant; (ii) phthalimido peroxy caproic acid; (iii) from 0 wt % to 10 wt % zeolite builder; (iv) from 0 wt % to 10 wt % phosphate builder; and (v) optionally from 0 wt % to 10 wt % silicate salt, wherein the upon dilution in de-ionized water to a concentration of 1 wt % at 20° C., the composition has a pH of from 7.6 to 8.8.

The composition is preferably a laundry detergent composition, although the composition can be a bleach additive composition.

The composition can be any suitable form, including free-flowing particulate form, or a unit dose form including tablet form, detergent sheet form. The composition may in the form of a pouch, for example the particles or tablet may be at least partially, preferably completely, enclosed by a film, preferably a water-soluble and/or water-dispersible film. A preferred film is a polyvinyl alcohol film. If the composition is in the form of a pouch, then the composition can be a single-compartment or a multi-compartment pouch. The multi-compartment pouch may comprise a liquid composition in one compartment and a solid composition in another compartment.

Typically, the composition is a fully formulated detergent composition, not a portion thereof such as a spray-drying or agglomerate particle that only forms part of the detergent composition. Typically, the composition comprises a plurality of chemically different particles, such as spray-dried base detergent particles and/or agglomerate base detergent particles and/or extrudate base detergent particles, in combination with one or more, typically two or more, or three or more, or four or more, or five or more, or six or more, or even ten or more particles selected from: surfactant particles, including surfactant agglomerates, surfactant extrudates, surfactant needles, surfactant noodles, surfactant flakes; builder particles, such as sodium carbonate and sodium silicate particles, phosphate particles, zeolite particles, silicate salt particles, carbonate salt particles; polymer particles such as cellulosic polymer particles, polyester particles, polyamine particles, terephthalate polymer particles, polyethylene glycol based polymer particles; aesthetic particles such as coloured noodles or needles or lamellae particles; enzyme particles such as protease prills, lipase prills, cellulase prills, amylase prills, mannanase prills, pectate lyase prills, xyloglucanase prills, and co-prills of any of these enzymes; bleach particles, such as percarbonate particles, especially coated percarbonate particles, such as percarbonate coated with carbonate salt, sulphate salt, silicate salt, borosilicate salt, or combinations thereof, perborate particles, bleach catalyst particles such as transition metal catalyst particles, or isoquinolinium bleach catalyst particles, pre-formed peracid particles, especially coated pre-formed peracid particles; filler particles such as sulphate salt particles; clay particles such as montmorillonite particles or particles of clay and silicone; flocculant particles such as polyethylene oxide particles, wax particles such as wax agglomerates, brightener particles, dye transfer inhibition particles; dye fixative particles, perfume particles such as perfume microcapsules and starch encapsulated perfume accord particles, or pro-perfume particles such as Schiff base reaction product particles, bleach activator particles such as oxybenzene sulphonate bleach activator particles and tetra acetyl ethylene diamine bleach activator particles; hueing dye particles; chelant particles such as chelant agglomerates; and any combination thereof.

pH profile. The composition, upon dilution in de-ionized water to a concentration of 1 wt % at 20° C., has a pH of from 7.6 to 8.8, preferably from 8.0 to 8.4.

Reserve alkalinity. As used herein, the term "reserve alkalinity" is a measure of the buffering capacity of the detergent composition (g/NaOH/100 g detergent composition) determined by titrating a 1% (w/v) solution of detergent composition with hydrochloric acid to pH 6.0 i.e. in order to calculate Reserve Alkalinity as defined herein:

$$\text{Reserve Alkalinity (to pH 6.0) as \% alkali in g NaOH/100 g product} = \frac{T \times M \times 40 \times Vol}{10 \times \text{Wt} \times \text{Aliquot}}$$

T=titre (ml) to pH 6.0
M=Molarity of HC1=0.2
40=Molecular weight of NaOH
Vol=Total volume (i.e. 1000 ml)
W=Weight of product (10 g)
Aliquot=(100 ml)

Obtain a 10 g sample accurately weighed to two decimal places, of fully formulated detergent composition. The sample should be obtained using a Pascall sampler in a dust cabinet. Add the 10 g sample to a plastic beaker and add 200 ml of carbon dioxide-free de-ionised water. Agitate using a magnetic stirrer on a stirring plate at 150 rpm until fully dissolved and for at least 15 minutes. Transfer the contents of the beaker to a 1 liter volumetric flask and make up to 1 liter with deionised water. Mix well and take a 100 mls±1 ml aliquot using a 100 mls pipette immediately. Measure and record the pH and temperature of the sample using a pH meter capable of reading to ±0.01 pH units, with stirring, ensuring temperature is 21° C.+/−2° C. Titrate whilst stirring with 0.2M hydrochloric acid until pH measures exactly 6.0. Note the milliliters of hydrochloric acid used. Take the average titre of three identical repeats. Carry out the calculation described above to calculate the reserve alkalinity to pH 6.0.

Preferably, the composition has a reserve alkalinity to pH 6.0 of at least 3.0, preferably at least 4.0, or at least 5.0, or at least 6.0, or at least 7.0, or at least 8.0, or at least 9.0, or at least 10.0, or even at least 12.0, or at least 14.0, or at least 16.0, or at least 18, or at least 20.0.

Detersive surfactant. Suitable detersive surfactants include anionic detersive surfactants, non-ionic detersive surfactant, cationic detersive surfactants, zwitterionic detersive surfactants and amphoteric detersive surfactants.

Preferred anionic detersive surfactants include sulphate and sulphonate detersive surfactants.

Preferred sulphonate detersive surfactants include alkyl benzene sulphonate, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Preferred sulphate detersive surfactants include alkyl sulphate, preferably $C_{8-18}$ alkyl sulphate, or predominantly $C_{12}$ alkyl sulphate.

Another preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 1 to 20, preferably from 1 to 10, preferably the alkyl alkoxylated sulphate is a $C_{8-18}$ alkyl ethoxylated sulphate having an average degree of ethoxylation of from 1 to 10, preferably from 1 to 7, more preferably from 1 to 5 and most preferably from 1 to 3.

The alkyl sulphate, alkyl alkoxylated sulphate and alkyl benzene sulphonates may be linear or branched, substituted or un-substituted.

The detersive surfactant may be a mid-chain branched detersive surfactant, preferably a mid-chain branched anionic detersive surfactant, more preferably a mid-chain branched alkyl sulphate and/or a mid-chain branched alkyl benzene sulphonate, most preferably a mid-chain branched alkyl sulphate. Preferably, the mid-chain branches are $C_{1-4}$ alkyl groups, preferably methyl and/or ethyl groups.

Another suitable anionic detersive surfactant is alkyl ethoxy carboxylate. The anionic detersive surfactants are typically present in their salt form, typically being complexed with a suitable cation. Suitable counter-ions include $Na^+$ and $K^+$, substituted ammonium such as $C_1$-$C_6$ alkanolammonium preferably mono-ethanolamine (MEA) tri-ethanolamine (TEA), di-ethanolamine (DEA), and any mixtures thereof.

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, preferably having an average degree of alkoxylation of from 1 to 30; alkylpolysaccharides, preferably alkylpolyglycosides; polyhydroxy fatty acid amides; ether capped poly(oxyalkylated) alcohol surfactants; and mixtures thereof.

Preferred non-ionic detersive surfactants are alkyl polyglucoside and/or an alkyl alkoxylated alcohol.

Preferred non-ionic detersive surfactants include alkyl alkoxylated alcohols, preferably $C_{8-18}$alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. The alkyl alkoxylated alcohol can be linear or branched, and substituted or un-substituted.

Suitable nonionic detersive surfactants include secondary alcohol-based detersive surfactant having the formula:

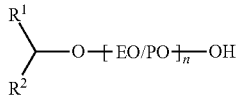

wherein $R^1$=linear or branched, substituted or unsubstituted, saturated or unsaturated $C_{2-8}$ alkyl;
wherein $R^2$=linear or branched, substituted or unsubstituted, saturated or unsaturated $C_{2-8}$ alkyl,
wherein the total number of carbon atoms present in $R^1$+$R^2$ moieties is in the range of from 7 to 13;
wherein EO/PO are alkoxy moieties selected from ethoxy, propoxy, or mixtures thereof, preferably the EO/PO alkoxyl moieties are in random or block configuration;
wherein n is the average degree of alkoxylation and is in the range of from 4 to 10.

Suitable cationic detersive surfactants include alkyl pyridinium compounds, alkyl quaternary ammonium compounds, alkyl quaternary phosphonium compounds, alkyl ternary sulphonium compounds, and mixtures thereof.

Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable zwitterionic and/or amphoteric detersive surfactants include alkanolamine sulpho-betaines.

Phthalimido peroxy caproic acid. The composition comprises phthalimido peroxycaproic acid in a solid or stable liquid form, at levels from 0.1 to 50 wt %. Suitable materials are commercially available from Solvay under the Eureco® brand name. One preferred form of phthalimido peroxycaproic acid is its beta-cyclodextrin inclusion complex sold as Cavamax® W7/Eureco® HC-Complex.

Phthalimido peroxycaproic acid is also known as: N,N-phthalimido peroxycaproic acid; 2H-Isoindole-2-hexaneperoxoic acid, 1,3-dihydro-1,3-dioxo-; 5-(Phthalimido)percaproic acid; 6-(Phthalimidoperoxy)hexanoic acid; 6-Phthalimidohexaneperoxoic acid; Eureco; Eureco HC; Eureco HCL 11; Eureco HCL 17; Eureco LX; Eureco W; Phthalimidoperhexanoic acid; e-(Phthalimidoperoxy)hexanoic acid; and 1,3-dihydro-1,3-dioxo-2H-Isoindole-2-hexaneperoxoic aci. The CAS number is 128275-31-0.

Phthalimido peroxycaproic acid has the following chemical structure:

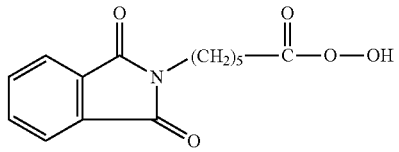

Bleach catalyst. Preferably the composition comprises bleach catalyst. Preferred bleach catalysts include oxaziridinium-based bleach catalysts, transition metal bleach catalysts, bleaching enzymes, and any combination thereof.

Preferably, the composition comprises oxaziridinium-based bleach catalyst having the formula:

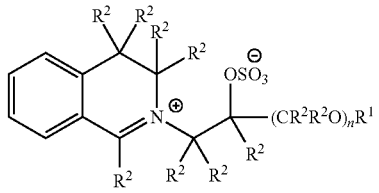

wherein: $R^1$ is selected from the group consisting of: H, a branched alkyl group containing from 3 to 24 carbons, and a linear alkyl group containing from 1 to 24 carbons; preferably, $R^1$ is a branched alkyl group comprising from 6 to 18 carbons, or a linear alkyl group comprising from 5 to 18 carbons, more preferably each $R^1$ is selected from the group consisting of: 2-propylheptyl, 2-butyloctyl, 2-pentylnonyl, 2-hexyldecyl, n-hexyl, n-octyl, n-decyl, n-dodecyl, n-tetradecyl, n-hexadecyl, n-octadecyl, iso-nonyl, iso-decyl, iso-tridecyl and iso-pentadecyl; $R^2$ is independently selected from the group consisting of: H, a branched alkyl group comprising from 3 to 12 carbons, and a linear alkyl group comprising from 1 to 12 carbons; preferably $R^2$ is independently selected from H and methyl groups; and n is an integer from 0 to 1.

Lipase. Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*) as described in EP 258 068 and EP 305 216 or from *H. insolens* as described in WO 96/13580, a *Pseudomonas lipase*, e.g., from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus lipase*, e.g., from *B. subtilis* (Dartois et al. (1993), Biochemica et Biophysica Acta, 1131, 253-360), *B. stearothermophilus* (JP 64/744992) or *B. pumilus* (WO 91/16422).

The lipase may be a "first cycle lipase" such as those described in U.S. Pat. No. 6,939,702 and US PA 2009/0217464. In one aspect, the lipase is a first-wash lipase, preferably a variant of the wild-type lipase from *Thermomyces lanuginosus* comprising T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Preferred lipases would include those sold under the tradenames Lipex®, Lipolex® and Lipoclean® by Novozymes, Bagsvaerd, Denmark.

Preferably, the composition comprises a variant of *Thermomyces lanuginosa* lipase having >90% identity with the wild type amino acid and comprising substitution(s) at T231 and/or N233, preferably T231R and/or N233R.

Protease. Suitable proteases include metalloproteases and/or serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044,993.

Preferred proteases include those derived from *Bacillus gibsonii* or *Bacillus Lentus.*

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Preferably, the composition comprises a subtilisin protease selected from BLAP, BLAP R, BLAP X or BLAP F49.

Cellulase. Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. No. 4,435,307, U.S. Pat. No. 5,648,263, U.S. Pat. No. 5,691,178, U.S. Pat. No. 5,776,757 and WO 89/09259.

Especially suitable cellulases are the alkaline or neutral cellulases having colour care benefits. Examples of such cellulases are cellulases described in EP 0 495 257, EP 0 531 372, WO 96/11262, WO 96/29397, WO 98/08940. Other examples are cellulase variants such as those described in WO 94/07998, EP 0 531 315, U.S. Pat. No. 5,457,046, U.S. Pat. No. 5,686,593, U.S. Pat. No. 5,763,254, WO 95/24471, WO 98/12307 and PCT/DK98/00299.

Commercially available cellulases include CELLUZYME®, and CAREZYME® (Novozymes A/S), CLAZINASE®, and PURADAX HA® (Genencor International Inc.), and KAC-500(B)® (Kao Corporation).

In one aspect, the cellulase can include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403) and mixtures thereof. Suitable endoglucanases are sold under the tradenames Celluclean® and Whitezyme® (Novozymes A/S, Bagsvaerd, Denmark).

Preferably, the composition comprises a cleaning cellulase belonging to Glycosyl Hydrolase family 45 having a molecular weight of from 17 kDa to 30 kDa, for example the endoglucanases sold under the tradename Biotouch® NCD, DCC and DCL (AB Enzymes, Darmstadt, Germany).

Amylase. Preferably, the composition comprises an amylase with greater than 60% identity to the AA560 alpha amylase endogenous to *Bacillus* sp. DSM 12649, preferably a variant of the AA560 alpha amylase endogenous to *Bacillus* sp. DSM 12649 having: (a) mutations at one or more of positions 9, 26, 149, 182, 186, 202, 257, 295, 299, 323, 339 and 345; and (b) optionally with one or more, preferably all of the substitutions and/or deletions in the following positions: 118, 183, 184, 195, 320 and 458, which if present preferably comprise R118K, D183*, G184*, N195F, R320K and/or R458K.

Suitable commercially available amylase enzymes include Stainzyme® Plus, Stainzyme®, Natalase, Termamyl®, Termamyl® Ultra, Liquezyme® SZ (all Novozymes, Bagsvaerd, Denmark) and Spezyme® AA or Ultraphlow (Genencor, Palo Alto, USA).

Choline oxidase Preferably, the composition comprises a choline oxidase enzyme such as the 59.1 kDa choline oxidase enzyme endogenous to *Arthrobacter nicotianae*, produced using the techniques disclosed in D. Ribitsch et al., Applied Microbiology and Biotechnology, Volume 81, Number 5, pp 875-886, (2009).

Other enzymes. Other suitable enzymes are peroxidases/oxidases, which include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257.

Commercially available peroxidases include GUARDZYME® (Novozymes A/S).

Other preferred enzymes include pectate lyases sold under the tradenames Pectawash®, Pectaway® and mannanases sold under the tradenames Mannaway® (all from Novozymes A/S, Bagsvaerd, Denmark), and Purabrite® (Genencor International Inc., Palo Alto, Calif.).

Identity. The relativity between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

Zeolite builder. The composition typically comprises from 0 wt % to 10 wt %, zeolite builder, preferably to 8 wt %, or to 6 wt %, or to 4 wt %, or to 3 wt %, or to 2 wt %, or even to 1 wt % zeolite builder. The composition may even be substantially free of zeolite builder; substantially free means "no deliberately added". Typical zeolite builders include zeolite A, zeolite P and zeolite MAP.

Phosphate builder. The composition typically comprises from 0 wt % to 10 wt % phosphate builder, preferably to 8 wt %, or to 6 wt %, or to 4 wt %, or to 3 wt %, or to 2 wt %, or even to 1 wt % phosphate builder. The composition may even be substantially free of phosphate builder; substantially free means "no deliberately added". A typical phosphate builder is sodium tri-polyphosphate.

Silicate salt. The composition may preferably comprise from 0 wt % to 10 wt % silicate salt, preferably to 9 wt %, or to 8 wt %, or to 7 wt %, or to 6 wt %, or to 5 wt %, or to 4 wt %, or to 3 wt %, or even to 2 wt %, and preferably from above 0 wt %, or from 0.5 wt %, or even from 1 wt % silicate salt. A preferred silicate salt is sodium silicate. Sodium meta-silicate is also a preferred silicate salt.

Carbonate salt. The composition may preferably comprise from 10 wt % to 80 wt % carbonate salts selected from alkali metal carbonates and alkali metal bicarbonates, wherein the total level of alkali metal bicarbonates is greater, in wt % terms, than the total level of alkali metal carbonates. More preferably, the weight ratio of alkali metal bicarbonates is at least three times greater, in wt % terms than the total level of alkali metal carbonates. The carbonate salts may be introduced in any form, for example powder, granule, bead or noodles of sodium carbonate, sodium bicarbonate and sodium sesquicarbonate dihydrate. Sodium percarbonate is a source of sodium carbonate.

Brightener. It may be preferred for the composition to comprise fluorescent brighteners such as disodium 4,4'-bis(2-sulfostyryl)biphenyl (C.I. Fluorescent Brightener 351); C.I. Fluorescent Brightener 260, or analogues with its anilino- or morpholino-groups replaced by other groups. The composition may preferably comprise bleach-stable fluorescent brighteners such as bis(sulfobenzofuranyl)biphenyl, commercially available from Ciba Specialty Chemicals as Tinopal® PLC.

Hueing agent. It may be preferred for the composition to comprise an oxidation-resistant hueing agent. Preferred oxidation-resistant hueing agents are selected from C.I. direct violet 7, C.I. direct violet 9, C.I. direct violet 11, C.I. direct violet 26, C.I. direct violet 31, C.I. direct violet 35, C.I. direct violet 40, C.I. direct violet 41, C.I. direct violet 51, C.I. direct violet 66, C.I. direct violet 99, C.I. acid violet 50, C.I. acid blue 9, C.I. acid violet 17, C.I. acid black 1, C.I. acid red 17, C.I. acid blue 29, C.I. solvent violet 13, C.I. disperse violet 27, C.I. disperse violet 26, C.I. disperse violet 28, C.I. disperse violet 63, C.I. disperse violet 77, C.I. basic blue 16, C.I. basic blue 65, C.I. basic blue 66, C.I. basic blue 67, C.I. basic blue 71, C.I. basic blue 159, C.I. basic violet 19, C.I. basic violet 35, C.I. basic violet 38, C.I. basic violet 48; C.I. basic blue 3, C.I. basic blue 75, C.I. basic blue 95, C.I. basic blue 122, C.I. basic blue 124, C.I. basic blue 141, C.I. reactive blue 19, C.I. reactive blue 163, C.I. reactive blue 182, C.I. reactive blue and C.I. reactive blue 96.

Fabric integrity polymer. It may be preferred for the composition to comprise a cellulosic fabric integrity polymer such as hydrophobically modified carboxymethyl cellulose, for example the alkyl ketene dimer derivative of carboxymethylcellulose sold commercially by CPKelco as Finnfix® SH1, or the blocky carboxymethylcellulose sold commercially by CPKelco as Finnfix® V.

Dye lock ingredient. It may be preferred for the composition to comprise a dye lock ingredient. Preferred dye lock ingredients are cyclic amine based polymers such as those disclosed in EP1015543 (P&G), especially epichlorohydrin/imidazole adduct copolymers.

Other detergent ingredients. The composition typically comprises other detergent ingredients. Suitable detergent ingredients include: transition metal bleach catalysts; oxaziridinium-based bleach catalysts; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6R and 2.0R sodium silicate, or sodium metasilicate; copolyesters of di-carboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof.

A method of laundering fabric. The method of laundering fabric typically comprises the step of contacting the solid detergent composition to water to form a wash liquor, and laundering fabric in said wash liquor, wherein typically the wash liquor has a temperature of above 0° C. to 20° C., preferably to 19° C., or to 18° C., or to 17° C., or to 16° C., or to 15° C., or to 14° C., or to 13° C., or to 12° C., or to 11° C., or to 10° C., or to 9° C., or to 8° C., or to 7° C., or to 6° C., or even to 5° C. The fabric may be contacted to the water prior to, or after, or simultaneous with, contacting the laundry detergent composition with water.

Typically, the wash liquor is formed by contacting the detergent to water in such an amount so that the concentration of laundry detergent composition in the wash liquor is from above 0 g/l to 5 g/l, preferably from 1 g/l, and preferably to 4.5 g/l, or to 4.0 g/l, or to 3.5 g/l, or to 3.0 g/l, or to 2.5 g/l, or even to 2.0 g/l, or even to 1.5 g/1.

Highly preferably, the method of laundering fabric is carried out in a front-loading automatic washing machine. In this embodiment, the wash liquor formed and concentration of laundry detergent composition in the wash liquor is that of the main wash cycle. Any input of water during any optional rinsing step(s) that typically occurs when laundering fabric using a front-loading automatic washing machine is not included when determining the volume of the wash liquor. Of course, any suitable automatic washing machine may be used, although it is extremely highly preferred that a front-loading automatic washing machine is used.

It is highly preferred for the wash liquor to comprise 40 liters or less of water, preferably 35 liters or less, preferably 30 liters or less, preferably 25 liters or less, preferably 20 liters or less, preferably 15 liters or less, preferably 12 liters or less, preferably 10 liters or less, preferably 8 liters or less, or even 6 liters or less of water. Preferably, the wash liquor comprises from above 0 to 15 liters, or from 1 liter, or from 2 liters, or from 3 liters, and preferably to 12 liters, or to 10 liters, or even to 8 liters of water. Most preferably, the wash liquor comprises from 1 liter, or from 2 liters, or from 3 liters, or from 4 liters, or even from 5 liters of water.

Typically from 0.01 kg to 2 kg of fabric per liter of wash liquor is dosed into said wash liquor. Typically from 0.01 kg, or from 0.02 kg, or from 0.03 kg, or from 0.05 kg, or from 0.07 kg, or from 0.10 kg, or from 0.12 kg, or from 0.15 kg, or from 0.18 kg, or from 0.20 kg, or from 0.22 kg, or from 0.25 kg fabric per liter of wash liquor is dosed into said wash liquor.

Preferably 50 g or less, more preferably 45 g or less, or 40 g or less, or 35 g or less, or 30 g or less, or 25 g or less, or 20 g or less, or even 15 g or less, or even 10 g or less of laundry detergent composition is contacted to water to form the wash liquor.

Preferably, the laundry detergent composition is contacted to from above 0 liters, preferably from above 1 liter, and preferably to 70 liters or less of water to form the wash liquor, or preferably to 40 liters or less of water, or preferably to 35 liters or less, or preferably to 30 liters or less, or preferably to 25 liters or less, or preferably to 20 liters or less, or preferably to 15 liters or less, or preferably to 12 liters or less, or preferably to 10 liters or less, or preferably to 8 liters or less, or even to 6 liters or less of water to form the wash liquor.

EXAMPLES

Unless otherwise indicated, materials can be obtained from Sigma-Aldrich, The Old Brickyard, Gillingham, Dorset, United Kingdom The compositions are made by combining the listed ingredients in the listed proportions (weight % of active material except where noted otherwise).

Examples 1-6

Granular dry laundry detergent compositions designed for use in washing machines or hand washing processes.

Current typical usage concentrations for these products range from 0.5-20 g product per liter of wash water, e.g. an 80 g dose for 15 L wash volume. However, in the future with increasing product compaction, it would be feasible to reduce the level of sodium sulfate and/or sodium carbonate in these compositions and increase the quantities of the other constituents so as to achieve the same amounts of active ingredients in the wash at a lower dosage.

| | 1 wt %* | 2 wt %* | 3 wt %* | 4 wt %* | 5 wt %* | 6 wt %* |
|---|---|---|---|---|---|---|
| Sodium linear alkylbenzenesulfonate with average aliphatic chain length $C_{11-12}$ | 10.3 | 10.7 | 14.0 | 17.0 | 12.2 | 8.3 |
| Sodium lauryl sulfate | — | 3.5 | — | 1.4 | 1.2 | — |
| Sodium $C_{12-14}$ alcohol ethoxy-3-sulfate | — | — | 0.8 | — | — | 3.0 |
| $C_{13-15}$ oxo alcohol ethoxylate with average 7 moles of ethoxylation (Lutensol ® AO7) | 1.57 | — | — | — | 1.2 | — |
| $C_{10}$-Guerbet (2-propylheptan-1-ol) alcohol ethoxylate with average 7 moles of ethoxylation (Lutensol ® XP70) | — | 1.5 | — | — | 1.2 | — |
| $C_{16-18}$ alcohol ethoxylate with average 7 moles of ethoxylation | — | 0.5 | — | — | 0.3 | — |
| $C_{12-18}$ alcohol ethoxylate with average 5 moles of ethoxylation | — | 0.3 | — | — | — | — |
| $C_{12-14}$ alkyl hydroxyethyl dimethyl ammonium chloride (Praepagen ® HY) | | | 0.7 | 0.54 | 0.1 | 1.0 |
| Sodium tripolyphosphate | — | — | 0.6 | — | 1.0 | — |
| Zeolite A | 2.7 | 3.4 | — | — | 0.5 | 1.6 |
| Citric acid | 1.8 | 2.0 | — | 1.4 | — | 2.0 |
| Sodium citrate | — | 1.9 | — | — | — | — |
| Sodium bicarbonate | 29.0 | 35.0 | 36.7 | 34.0 | 53.0 | 22.0 |

-continued

| | 1 wt %* | 2 wt %* | 3 wt %* | 4 wt %* | 5 wt %* | 6 wt %* |
|---|---|---|---|---|---|---|
| Sodium sesquicarbonate dihydrate | — | — | 1.2 | — | — | — |
| Sodium carbonate | 1.2 | — | 1.9 | — | — | — |
| Sodium polyacrylate (MW 4000, Sokalan PA25 CL) | — | — | 1.0 | — | — | — |
| Sodium polyacrylate (MW 8000, Sokalan PA30 CL) | 1.45 | 1.6 | — | 0.97 | 1.0 | — |
| Sodium polyacrylate/ maleate copolymer MW 70,000, 70:30 ratio, Sokalan ® CP5 | — | — | 0.3 | — | — | 3.0 |
| Polyethylene glycol/vinyl acetate random graft copolymer | — | — | 0.8 | 1.0 | 1.0 | — |
| Carboxymethyl cellulose (Finnfix ® GDA) | 1.0 | 0.9 | — | — | — | — |
| Carboxymethyl cellulose (Finnfix ® V) | — | — | — | 0.3 | 1.1 | 0.92 |
| Hydrophobically modified carboxymethyl cellulose (Finnfix ® SH-1) | — | — | 0.5 | — | — | — |
| C.I. Fluorescent Brightener 260 | 0.10 | 0.13 | 0.10 | 0.03 | 0.05 | 0.18 |
| C.I. Fluorescent Brightener 351 (Tinopal ® CBS) | — | 0.06 | 0.08 | — | — | — |
| Diethylenetriamine pentaacetic acid | — | — | 0.2 | 0.1 | 0.2 | — |
| Tetrasodium S,S-ethylenediamine disuccinate | — | — | — | 0.3 | — | 0.3 |
| Diethylenetriamine penta (methylene phosphonic acid), heptasodium salt | — | 0.2 | — | — | — | — |
| 1-Hydroxyethane-1,1-diphosphonic acid | 0.1 | 0.2 | 0.3 | — | 0.2 | 0.4 |
| 2-Phosphonobutane 1,2,4-tricarboxylic acid (Bayhibit ® AM) | — | — | — | 0.4 | — | — |
| $MgSO_4$ | — | — | — | 0.8 | — | 0.4 |
| N,N-Phthalimidoperoxycaproic acid | 2.0 | 1.4 | 0.7 | 4.3 | 2.2 | 1.9 |
| Oxaziridinium-based bleach booster | 0.03 | — | 0.03 | 0.02 | 0.05 | 0.02 |
| Protease (Savinase ®)* | 4.3 | 3.3 | 6.3 | 5.7 | 3.3 | — |
| Protease (BLAP-X)* | — | — | — | — | — | 2.2 |
| Amylase (Stainzyme ® Plus)* | 2.2 | 1.51 | 1.0 | 2.2 | 1.9 | 3.3 |
| Lipase (Lipex ®)* | 3.3 | — | — | 8.3 | — | — |
| Lipase (Lipoclean ®)* | — | 26.0 | 3.6 | — | — | 2.7 |
| Endoglucanase (Celluclean ®)* | — | — | 5.3 | 3.3 | — | — |
| Choline oxidase* | 2.2 | — | — | — | 2.1 | 1.1 |
| Endoglucanase (Biotouch ® DCC)* | 2.1 | 1.3 | — | — | — | 2.4 |
| Mannaway ®* | 1.3 | 1.54 | 1.3 | — | 1.2 | 1.9 |
| Direct Violet 9 | — | — | 0.0003 | 0.0004 | — | — |
| Solvent Violet 13 | — | — | 0.002 | — | — | — |
| Soil release polymer (Texcare ® SRA300F) | 0.3 | 1.2 | — | 1.0 | 0.33 | 0.3 |
| Dye lock | 0.02 | 0.02 | — | — | — | — |
| Photobleach Mixture of zinc and aluminium phthalocyanine tetrasulfonates (Tinolux ® BMC) | — | — | — | — | — | 0.0015 |
| Photobleach C.I. Food Red 14 | — | — | 0.001 | — | — | 0.001 |
| Suds suppressor granule | 0.2 | 0.2 | — | — | — | 0.3 |
| Moisture | 7.0 | 6.3 | 8.9 | 9.1 | 4.3 | 4.6 |
| Perfume | 0.2 | 0.3 | 0.4 | 0.3 | 0.2 | 0.3 |
| Sodium sulfate | Balance to 100% | Balance to 100% | Balance to 100% | Balance to 100% | Balance to 100% | Balance to 100% |

*All enzyme levels expressed as mg active enzyme protein per 100 g detergent composition Notes for Examples:

Surfactant ingredients can be obtained from BASF, Ludwigshafen, Germany (Lutensol®); Shell Chemicals, London, UK; Stepan, Northfield, Ill., USA; Huntsman, Huntsman, Salt Lake City, Utah, USA; Clariant, Sulzbach, Germany (Praepagen®).

Sodium tripolyphosphate can be obtained from Rhodia, Paris, France.

Zeolite can be obtained from Industrial Zeolite (UK) Ltd, Grays, Essex, UK.

Citric acid and sodium citrate can be obtained from Jungbunzlauer, Basel, Switzerland.

Sodium carbonate, sodium bicarbonate and sodium sesquicarbonate can be obtained from Solvay, Brussels, Belgium.

Polyacrylate, polyacrylate/maleate copolymers can be obtained from BASF, Ludwigshafen, Germany.

Polyethylene glycol/vinyl acetate random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. It can be obtained from BASF, Ludwigshafen, Germany.

Carboxymethylcellulose and hydrophobically modified carboxymethyl cellulose can be obtained from CPKelco, Arnhem, The Netherlands.

C.I. Fluorescent Brightener 260 can be obtained from 3V Sigma, Bergamo, Italy as Optiblanc® Optiblanc® 2M/G, Optiblanc® 2MG/LT Extra, or Optiblanc® Ecobright.

C.I. Fluorescent Brightener 351 can be obtained from Ciba Specialty Chemicals, Basel, Switzerland as Tinopal® CBS-X.

Diethylenetriamine pentaacetic acid can be obtained from Dow Chemical, Midland, Mich., USA.

Tetrasodium S,S-ethylenediamine disuccinate can be obtained from Innospec, Ellesmere Port, UK.

Diethylenetriamine penta(methylene phosphonic acid), heptasodium salt, can be obtained from Dow Chemical, Midland, Mich., USA.

1-Hydroxyethane-1,1-diphosphonic acid can be obtained from Thermphos, Vlissingen-Oost, The Netherlands.

2-Phosphonobutane 1,2,4-tricarboxylic acid can be obtained from Bayer, Leverkusen, Germany as Bayhibit® AM.

Phthalimidoperoxycaproic acid can be obtained from Solvay, Brussels, Belgium

Oxaziridinium-based bleach booster has the following structure, where $R^1$=2-butyloctyl, and was produced according to US 2006/0089284A1.

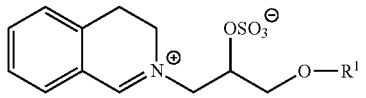

Enzymes Savinase®, Stainzyme® Plus, Lipex®, Lipoclean®, Celluclean® and Mannaway® can be obtained from Novozymes, Bagsvaerd, Denmark.

Enzyme BLAP-X can be obtained from Biozym, Kundl, Austria.

Enzyme Biotouch® DCC can be obtained from AB Enzymes, Darmstadt, Germany. Choline Oxidase enzyme is the 59.1 kDa choline oxidase enzyme endogenous to *Arthrobacter nicotianae*, produced using the techniques disclosed in D. Ribitsch et al., Applied Microbiology and Biotechnology, Volume 81, Number 5, pp 875-886, (2009).

Direct Violet 9 can be obtained from Ciba Specialty Chemicals, Basel, Switzerland.

Solvent Violet 13 can be obtained from Ningbo Lixing Chemical Co., Ltd. Ningbo, Zhejiang, China.

Soil release polymer can be obtained from Clariant, Sulzbach, Germany, as Texcare® SRA300F.

Dye lock is the imidazole/epichlorohydrin copolymer of EP1015543, example 1.

Mixture of zinc and aluminium phthalocyanine tetrasulfonates can be obtained from Ciba Specialty Chemicals, Basel, Switzerland, as Tinolux® BMC.

Suds suppressor granule can be obtained from Dow Corning, Barry, UK.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A solid fabric treatment detergent composition comprising:

(i) detersive surfactant;

(ii) Phthalimido peroxycaproic acid;

(iii) from about 0 wt % to about 10 wt % zeolite builder;

(iv) from about 0 wt % to about 10 w % phosphate builder; and (v) from about 0 wt % to about 10 wt % silicate salt, wherein upon dilution in de-ionized water to a concentration of 1 wt % at 20° C., the composition has a pH of from about 7.6 to about 8.8; and the composition has a reserve alkalinity to pH 6.0 of at least about 5.0 g NaOH/100 g detergent composition;

wherein the composition comprises from about 10 wt % to about 80 wt % carbonate salts selected from alkali metal carbonates and bicarbonates, and wherein the total level of alkali metal bicarbonates is greater, in wt % terms, than the total level of alkali metal carbonates, wherein the composition further comprises at least one oxidation-resistant hueing agent selected from C.I. direct violet 7, C.I. direct violet 9, C.I. direct violet 11, C.I. direct violet 26, C.I. direct violet 31, C.I. direct violet 35, C.I. direct violet 40, C.I. direct violet 41, C.I. direct violet 51, C.I. direct violet 66, C.I. direct violet 99, C.I. acid violet 50, C.I. acid blue 9, C.I. acid violet 17, C.I. acid black 1, C.I. acid red 17, C.I. acid blue 29, C.I. solvent violet 13, C.I. disperse violet 27, C.I. disperse violet 26 C.I. disperse violet 28, C.I. disperse violet 63, C.I. disperse violet 77, C.I. basic blue 16, C.I. basicblue 65, C.I. basic blue 66, C.I. basic blue 67, C.I. basic blue 71, C.I. basic blue 159, C.I. basic violet 19, C.I. basic violet 35, C.I. basic violet 38, C.I. basic violet 48; C.I. basic blue 3, C.I. basic blue 75, C.I. basic blue 95, C.I. basic blue 122, C.I. basic blue 124, C.I. basic blue 141, C.I reactive blue 19, C.I. reactive blue 163, C.I. reactive blue 182, C.I. reactive blue and C.I. reactive blue 96.

2. A composition according to claim 1, wherein upon dilution in de-ionized water to a concentration of 1 wt % at 20° C., the composition has a pH in the range of from about 8.0 to about 8.4.

3. A composition according to claim 1, wherein the weight ratio of alkali metal bicarbonates is at least three times greater, in wt % terms than the total level of alkali metal carbonates.

4. A composition according to claim 1, wherein the composition comprises a bleach catalyst.

5. A composition according to claim 1, wherein the composition further comprises oxaziridinium-based bleach catalyst.

6. A composition according to claim 1, wherein the composition further comprises a transition metal bleach catalyst.

7. A composition according to claim 1, wherein the composition further comprises at least one oxidoreductase enzyme.

8. A composition according to claim 1, wherein the composition further comprises variant of *Thermomyces lanuginosa* lipase having >90% identity with the wild type amino acid and comprising substitution(s) at T231 and/or N233.

9. A composition according to claim 1, wherein the composition further comprises a fluorescent brightener selected from disodium 4,4'-bis(2-sulfostyryl)biphenyl and/or bis (sulfobenzofuranyl)biphenyl.

10. A composition according to claim 1, wherein the composition further comprises a cellulosic fabric integrity polymer.

11. A composition according to claim 1, wherein the composition further comprises a polymeric dye lock ingredient.

12. A composition according to claim 1, wherein the composition is a laundry detergent composition.

13. A composition according to claim 1, wherein the composition is bleach additive composition.

14. A composition according to claim 1, wherein the phthalimido peroxycaproic acid is in the form of its beta-cyclodextrin inclusion complex.

* * * * *